US009299214B2

(12) United States Patent
Chudd et al.

(10) Patent No.: US 9,299,214 B2
(45) Date of Patent: Mar. 29, 2016

(54) METER SHIELD FOR USE WITH GAMING DEVICES

(75) Inventors: Russell Chudd, Reno, NV (US); Lucas William Landau, Reno, NV (US); Michael Thomas Garamendi, Reno, NV (US); John Leagh Beadell, Sparks, NV (US)

(73) Assignee: IGT, Las Vegas, NV (US)

( * ) Notice: Subject to any disclaimer, the term of this patent is extended or adjusted under 35 U.S.C. 154(b) by 1007 days.

(21) Appl. No.: 12/545,544

(22) Filed: Aug. 21, 2009

(65) Prior Publication Data

US 2011/0045903 A1 Feb. 24, 2011

(51) Int. Cl.
*A63F 9/24* (2006.01)
*G07F 17/32* (2006.01)

(52) U.S. Cl.
CPC ..... *G07F 17/32* (2013.01); *G07F 17/3202* (2013.01)

(58) Field of Classification Search
CPC . G07F 17/32; G07F 17/3202; A63F 11/0051; A63F 2009/2458
USPC ..... 463/30, 31
See application file for complete search history.

(56) References Cited

U.S. PATENT DOCUMENTS

| | | | | |
|---|---|---|---|---|
| 3,814,908 | A | 6/1974 | Wakabayashi | |
| 4,570,934 | A * | 2/1986 | Smyth | 273/143 R |
| 5,578,807 | A | 11/1996 | Tsukakoshi | |
| 6,859,510 | B1 | 2/2005 | Ishida | |
| 7,379,523 | B2 | 5/2008 | Ishida | |
| 2005/0187009 | A1 * | 8/2005 | Osawa | 463/20 |
| 2006/0128464 | A1 * | 6/2006 | Okada | 463/29 |
| 2007/0290437 | A1 * | 12/2007 | Collings | 273/148 B |
| 2009/0061987 | A1 * | 3/2009 | Canterbury et al. | 463/20 |
| 2009/0302533 | A1 * | 12/2009 | Smith | 273/108.1 |
| 2010/0061093 | A1 * | 3/2010 | Janssen et al. | 362/235 |
| 2011/0009189 | A1 * | 1/2011 | Jordan et al. | 463/30 |

* cited by examiner

*Primary Examiner* — David L Lewis
*Assistant Examiner* — Robert Mosser
(74) *Attorney, Agent, or Firm* — Neal, Gerber & Eisenberg LLP

(57) ABSTRACT

A gaming device includes a cabinet having a front surface, wherein at least a portion of the front surface includes an optically restrictive material. The gaming device also includes at least one indicator positioned with respect to the optically restrictive material, wherein the at least one indicator is configured to display an event indication through said optically restrictive material when illuminated by light.

33 Claims, 5 Drawing Sheets

METER SHIELD FOR USE WITH GAMING DEVICES

BACKGROUND

The embodiments described herein relate generally to gaming devices and, more particularly, to a partially light-reflective or partially opaque shield that may be used with a gaming device to improve visibility of one or more event indicators by authorized viewers while simultaneously shielding the indicators from unauthorized viewers.

At least some known gaming devices include a plurality of electromagnetic counters used in counting and displaying a number of events. For example, at least some known counters are coupled, using a case, to an interior surface of a gaming device and include a light emitting diode (LED) that displays the counted number of events. The LED is coupled to printed wiring that extends along a length of the case such that the LED is positioned to one side of the counters. Known cases also include a cover member having a window, through which the counters are visible. A reflective surface is coupled to an interior surface of the cover member in order to reflect light from the LED onto the counters to render the counters visible when the LED is activated. However, known gaming devices do not obscure visibility of the counters to unauthorized viewers by using both an absence of light and a partially reflective surface.

BRIEF DESCRIPTION

This Brief Description is provided to introduce a selection of concepts in a simplified form that are further described below in the Detailed Description. This Brief Description is not intended to identify key features or essential features of the claimed subject matter, nor is it intended to be used as an aid in determining the scope of the claimed subject matter.

In one aspect, a gaming device is provided. The gaming device includes a cabinet having a front surface, wherein at least a portion of the front surface includes an optically restrictive material. The gaming device also includes at least one indicator positioned with respect to the optically restrictive material, wherein the at least one indicator is configured to display an event indication through said optically restrictive material when illuminated by light.

In another aspect, a method is provided for displaying an event indication for a gaming device that includes a cabinet having a front surface that includes an optically restrictive portion and at least one indicator that is configured to display the event indication. The method includes applying the optically restrictive portion to the front surface, positioning the at least one indicator with respect to the optically restrictive portion, detecting an event associated with the event indication, and displaying the at least one indicator through the optically restrictive portion to reveal the event indication.

In another aspect, a gaming system is provided. The gaming system includes a plurality of gaming devices, wherein each gaming device includes a cabinet comprising a front surface that includes an optically restrictive material, at least one indicator positioned with respect to the optically restrictive material and configured to display an event indication through said optically restrictive material when illuminated by light, and a controller coupled to the at least one indicator. The gaming system also includes at least one server coupled to the plurality of gaming devices via a network, wherein the at least one server is configured to detect an event associated with the event notification.

BRIEF DESCRIPTION OF THE DRAWINGS

The embodiments described herein may be better understood by referring to the following description in conjunction with the accompanying drawings.

DETAILED DESCRIPTION

Figure 1:
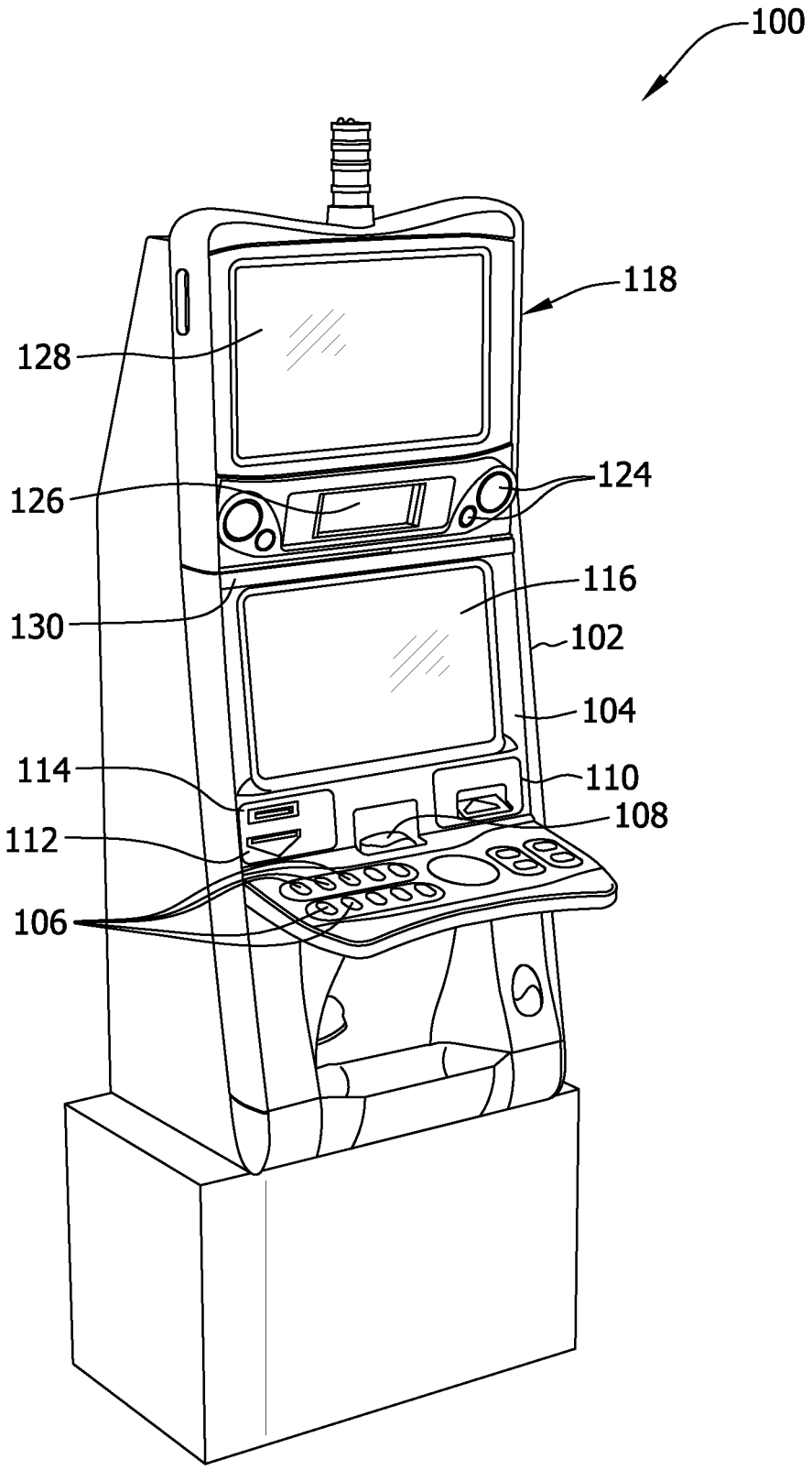
FIG. 1 is a schematic diagram of an exemplary gaming device.

In some embodiments, the term "gaming device" refers generally to a device located in or near an establishment that provides gaming, such as a casino, an airport, a restaurant, or a tavern. For example, a gaming device may be a gaming machine that enables play of one or more games by a player. Such a gaming machine may be, for example, a multi-reel slot machine, a video poker machine, or any other electrical or electromechanical gaming machine that enables a player to play a game. As another example, a gaming device may be a gaming terminal that communicates with one or more servers via a gaming network. As yet another example, a gaming device may be a kiosk that facilitates activities such as, but not limited to, purchasing tickets, making restaurant or hotel reservations, ordering food or drinks, and/or interacting with a player tracking system. Yet another example of such a device may be a vending machine that enables purchase of consumer products and/or refreshments. Accordingly, as used herein, the term "gaming device" may be understood to include any device that may be used by a player or patron of an establishment.

Exemplary applications of systems, methods, and apparatus according to the present invention are described herein. These examples are provided solely to add context and to aid in the understanding of the invention. It will thus be apparent to one skilled in the art that the present invention may be practiced without some or all of these specific details. In other instances, well known process steps have not been described in detail in order to avoid unnecessarily obscuring the present invention. Other applications are possible, such that the following example should not be taken as definitive or limiting either in scope or setting. In the detailed description that follows, references are made to the accompanying drawings, which form a part of the description and in which are shown, by way of illustration, specific embodiments of the present invention. Although these embodiments are described in sufficient detail to enable one skilled in the art to practice the invention, it is understood that these examples are not limiting, such that other embodiments may be used and changes may be made without departing from the spirit and scope of the invention.

The order of execution or performance of the operations in embodiments of the invention illustrated and described herein is not essential, unless otherwise specified. That is, the operations may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

Technical effects of the systems, methods, and apparatus described herein include at least one of (a) applying an optically reflective portion or optically opaque portion to a front surface of a gaming device, wherein the optically reflective or opaque portion may be a metallic substance sprayed on via vapor deposition, a polarized glass portion coupled to or integrally formed with the front surface, a tape or film applied to the front surface, or an integrally-formed portion of the front surface; (b) positioning one or more event indicators with respect to the optically reflective or opaque portion; (c) coupling the event indicators to a controller; (d) using the controller to monitor operation of the gaming device for events; and (e) illuminating the event indicators using one or more light devices in order to display an event indication related to the events detected by the controller.

Figure 2:
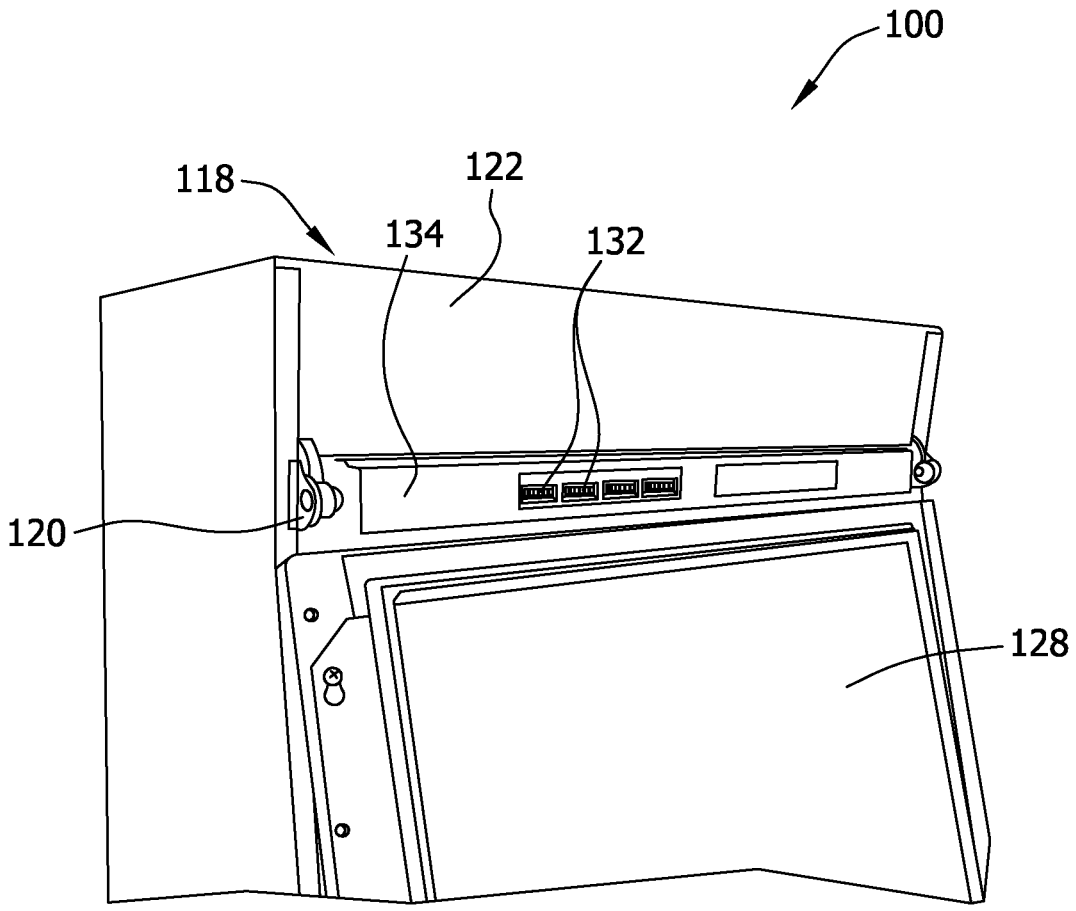
FIG. 2 is a schematic diagram of a portion of the gaming device shown in FIG. 1, including indicators that are hidden by an optically restrictive material.

FIG. 1 is a schematic diagram of an exemplary gaming device 100 that includes one or more indicators (not shown in FIG. 1) used to display one or more event notifications, and a shield (not shown in FIG. 1) fabricated from an optically restrictive material that substantially hides the indicators during normal use. FIG. 2 is a schematic diagram of a portion of gaming device 100, including indicators 132 that are hidden by the optically restrictive material (not shown in FIG. 2). Gaming device 100 may be any type of gaming machine as described above, and may include different structures or components other than those shown in FIG. 1. Moreover, gaming device 100 may use different methods of operation than those described below.

In the exemplary embodiment, gaming device 100 includes a main cabinet 102 that includes a front surface 104. A plurality of player-input switches and/or buttons 106 are coupled to front surface 104. Moreover, in the exemplary embodiment, gaming device 100 includes a coin acceptor 108 for accepting coins and/or tokens, and a bill acceptor 110 for accepting and/or validating cash bills. Further, gaming device 100 includes a ticket printer 112 for printing bar-coded tickets, and a card reader 114 for receiving a magnetic striped card containing player tracking information and/or player preferences or characteristics encoded thereon. Card reader 114 may also be used to accept coupons, credit cards, printed cards, smart cards, and/or ticket vouchers. A primary display 116 is viewable through front surface 104. In the exemplary embodiment, primary display 116 is implemented via a plurality of lighting devices (not shown in FIG. 1), such as a light emitting diode (LED) lighting display. However, in alternative embodiments, primary display 116 may be implemented as a cathode ray tube (CRT), a flat-panel liquid crystal display (LCD), a plasma display, an organic light-emitting diode (OLED) display, and/or any other electronically-controlled video display that incorporates a plurality of light devices. Moreover, primary display 116 may include touch screen capabilities. In some embodiments, symbols, images, and/or indicia displayed by primary display 116 may be in mechanical form. Accordingly, primary display 116 may include any suitable electromechanical devices that move one or more mechanical objects, such as one or more mechanical rotatable wheels, reels, or dice. Player-input buttons 106, coin acceptor 108, bill acceptor 110, ticket printer 112, card reader 114, and primary display 116 are each used by a player to play a game on gaming device 100. Each component 106, 108, 110, 112, 114, and/or 116 is controlled by a gaming device controller (not shown in FIG. 1) that is housed inside main cabinet 102. Numerous games including, but not limited to only including, video slot games, video poker, video pachinko, video black jack, video card games, and/or video keno may be implemented for play on gaming device 100.

In the exemplary embodiment, gaming device 100 also includes a top portion 118 that is positioned above main cabinet 102. Referring primarily to FIG. 2, and in the exemplary embodiment, top portion 118 is coupled to main cabinet 102 via a plurality of hinges 120. An interior 122 of top portion 118 is exposed when top portion 118 is open, as shown in FIG. 2. Referring again to FIG. 1, top portion 118 includes a number of devices that may be used to add features to a game being played on gaming device 100. Such devices may include, but are not limited to only including, speakers 124, an information panel 126, and a secondary display 128 for displaying a secondary or bonus game and/or other gaming related images. In the exemplary embodiment, information panel 126 is be a back-lit, silk-screened glass panel that includes lettering (not shown) indicative of general game information including, for example, a number of coins wagered. Moreover, information panel 126 may include touch screen capabilities. In the exemplary embodiment, secondary display 128 is implemented via a plurality of lighting devices (not shown in FIG. 1), such as an LED lighting display. However, in alternative embodiments, secondary display 128 may be implemented as a CRT, an LCD, a plasma display, an OLED display, and/or any other electronically-controlled video display that incorporates a plurality of light devices. During game play, such devices may be controlled by circuitry, such as the gaming device controller (not shown in FIG. 2) housed within main cabinet 102.

Moreover, in the exemplary embodiment, gaming device 100 includes a shield 130 fabricated from an optically restrictive material, such as an optically reflective material or an optically opaque material. In the exemplary embodiment, shield 130 extends across at least a portion of front surface 104. More specifically, in the exemplary embodiment, shield 130 is positioned between main cabinet 102 and top portion 118. In alternative embodiments, shield 130 may be positioned along at least one side of main cabinet 102. In the exemplary embodiment, shield 130 is fabricated, at least in part, from a film of a metallic or metalized substance, such as chrome, titanium, gold, or silver. However, it should be understood that any metallic or metalized substance may be used. Moreover, in the exemplary embodiment, a film is applied to a plastic or glass shield body using, for example, vapor deposition. In an alternative embodiment, shield 130 is fabricated polarized glass that prevents external visibility into gaming device 100. In another alternative embodiment, shield 130 is a tape or other suitable material that is applied to either an inner surface of front surface 104 or to an outer surface of front surface 104. In yet another embodiment, shield 130 is fabricated using an in-mold decorating process.

In the exemplary embodiment, shield 130 is coupled to front surface 104. In an alternative embodiment, shield 130 is formed integrally with front surface 104. In one embodiment, a camera (not shown) is positioned within main cabinet 102 to record video or periodic pictures of an area adjacent to gaming device 100.

Moreover, as shown in FIG. 2, gaming device 100 includes one or more indicators 132 that each display a status related to the operation of gaming device 100 and/or an event indication for each occurrence of an event during operation of gaming device 100. Indicators 132 are covered by shield 130 (shown in FIG. 1) such that a casual or unauthorized observer cannot see through shield 130 to observe indicators 132. In the exemplary embodiment, indicators 132 are installed in a meter assembly 134 coupled to main cabinet 102. Specifically, in the exemplary embodiment, meter assembly 134 includes a housing 136 that is coupled to main cabinet 102. Moreover, indicators 132 are implemented using electromechanical meters that each include a counter. Each indicator 132 displays an event indication by incrementing the counter whenever an associated event occurs during use of gaming device 100. For example, each time a primary game is played using gaming device 100, a particular counter may be incremented. In another example, whenever a new patron enrolls in a player tracking system using gaming device 100, a particular counter is incremented. It should be understood that an occurrence of any suitable event that may be tracked by gaming device 100 may be displayed by incrementing an associated counter.

In an alternative embodiment, each indicator 132 is configured to display an event indication related to service of a particular component or subsystem of gaming device 100. For example, a first indicator 132 may become visible through shield 130 when a paper dispenser used by ticket printer 112 has run out of paper. In another example, a second indicator 132 may become visible through shield 130 when a software or communication error occurs. In another alternative embodiment, indicators 132 may be used to display to a player that a bonus game has been awarded during play of a base or primary game. Alternatively, indicators 132 may be used to display to the player that a bonus award has been awarded either during the bonus game or during the primary game. In yet another alternative embodiment, each indicator 132 may include a lip portion (not shown) that is coupled via a hinge (not shown) to main cabinet 102. In such an embodiment, in order to view event indications via indicator 132, the lip portion would be selectively raised or lowered such that the event indications become visible.

Figure 3:
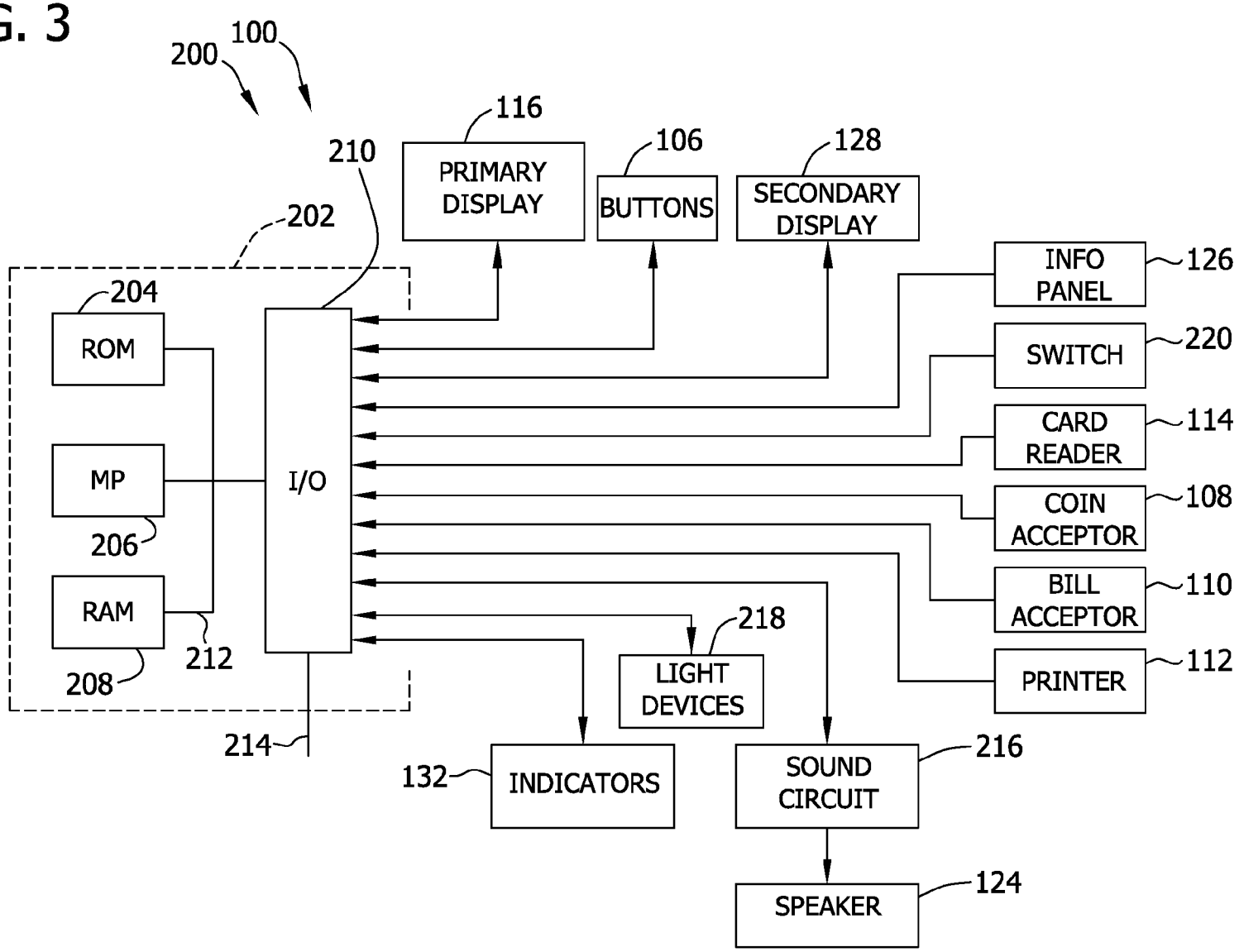
FIG. 3 is a block circuit diagram of an exemplary electrical architecture incorporated into the gaming device shown in FIGS. 1 and 2.

FIG. 3 is a block circuit diagram of an exemplary electrical architecture 200 incorporated into an exemplary gaming device, such as gaming device 100. In the exemplary embodiment, gaming device 100 includes a gaming device controller 202 that includes a read-only memory (ROM) 204, a microcontroller or microprocessor (MP) 206, a random-access memory (RAM) 208, and an input/output (I/O) circuit 210, that are each coupled via an address/data bus 212. As used herein, the terms "controller" and "processor" may include any programmable system including, but not limited to, systems using microcontrollers, reduced instruction set circuits (RISC), application specific integrated circuits (ASICs), logic circuits, and/or any other circuit or processor capable of executing the functions described herein. Such examples are exemplary only, and are thus not intended to limit in any way the definition and/or meaning of the terms "controller" or "processor". Alternative embodiments of controller 202 may include more than one microprocessor 206, multiple RAM modules 208, and/or multiple ROM modules 204. Moreover, although I/O circuit 210 is illustrated in FIG. 3 as a single component, one of ordinary skill in the art should appreciate that I/O circuit 210 may include any number or a plurality of different types of I/O circuits. Furthermore, RAM 208 and/or ROM 204 may be implemented as, for example, semiconductor memories, magnetically readable memories, and/or optically readable memories. In one embodiment, each operational component of gaming device 100 is coupled to I/O circuit 210 via a respective conductor. Alternative embodiments may include only a single coupling between the operational components of gaming device 100 and I/O circuit 210. In the exemplary embodiment, I/O circuit 210 is coupled to a gaming network (not shown) via a network interface 214. Moreover, in the exemplary embodiment, architecture 200 includes a sound circuit 216 that generates audio signals and that communicates audio signals between I/O circuit 210 and speakers 124.

In the exemplary embodiment, gaming device 100 also includes one or more light devices 218. Each light device 218 is coupled to main cabinet 102 (shown in FIGS. 1 and 2). Moreover, each light device 218 is used to illuminate a corresponding indicator 132, such that the corresponding indicator 132 is visible through shield 130 (shown in FIG. 1). Each light device 218 may be implemented as, for example, an LED light device. However, any suitable internal light device may be used. In the exemplary embodiment, gaming device 100 includes a switch 220 that is provided on an exterior surface of main cabinet 102 (shown in FIG. 1) or top portion 118 (shown in FIG. 2). When switch 220 is activated, light devices 218 are enabled to illuminate indicators 132. In an alternative embodiment, a combination of button presses using buttons 106 enables light devices 218 to illuminate indicators 132.

During operation, controller 202 monitors one or more events including events such as, but not limited to, coin in, games played, awards paid out, tickets printed, and/or a number of tickets remaining in a ticket hopper (not shown). For each occurrence of a particular event detected by controller 202, a signal is transmitted by controller 202 to a corresponding indicator 132. In response to the signal, the corresponding indicator 132 displays an event indication. In the exemplary embodiment, for each occurrence of a particular event detected by controller 202, a signal is transmitted by controller 202 to a corresponding indicator 132 within meter assembly 134. In response to the signal, the corresponding indicator 132 increments to show that a new occurrence of the event has occurred. At a predetermined time or according to a predetermined action, indicators 132 are illuminated by light devices 218. In one embodiment, controller 202 detects a user input via switch 220, or via a combination of button presses, and transmits a signal to a particular light device 218. The particular light device 218 illuminates a corresponding indicator 132 to display, for example, a number of games played using gaming device 100. Illuminating indicator 132 via light device 218 facilitates making indicator 132 visible through shield 130.

In an alternative embodiment, controller 202 monitors one or more components of gaming device 100. When controller 202 detects that an issue that requires attention by personnel has occurred, controller 202 transmits a signal to a corresponding indicator 132. In response to the signal, indicator 132 displays an event indication corresponding to the need for attention. For example, indicator 132 may be illuminated by a particular light device 218 in order to be viewable through shield 130. Alternatively, service personnel may be required to input a command via switch 220 or a combination of button presses in order for indicator 132 to be illuminated by light device 218, thereby making indicator 132 viewable through shield 130.

In another alternative embodiment, controller 202 monitors game play on gaming device 100. When controller 202 detects, for example, a bonus triggering event, controller 202 transmits a signal to a corresponding bonus indicator 132. In response to the signal, indicator 132 displays, for example, a bonus image. Moreover, in one embodiment, controller 202 transmits a signal to a particular light device 218 rather than to a particular indicator 132, and the particular light device 218 illuminates a corresponding bonus indicator 132, thereby making the indicator 132 visible through shield 130.

Figure 4:
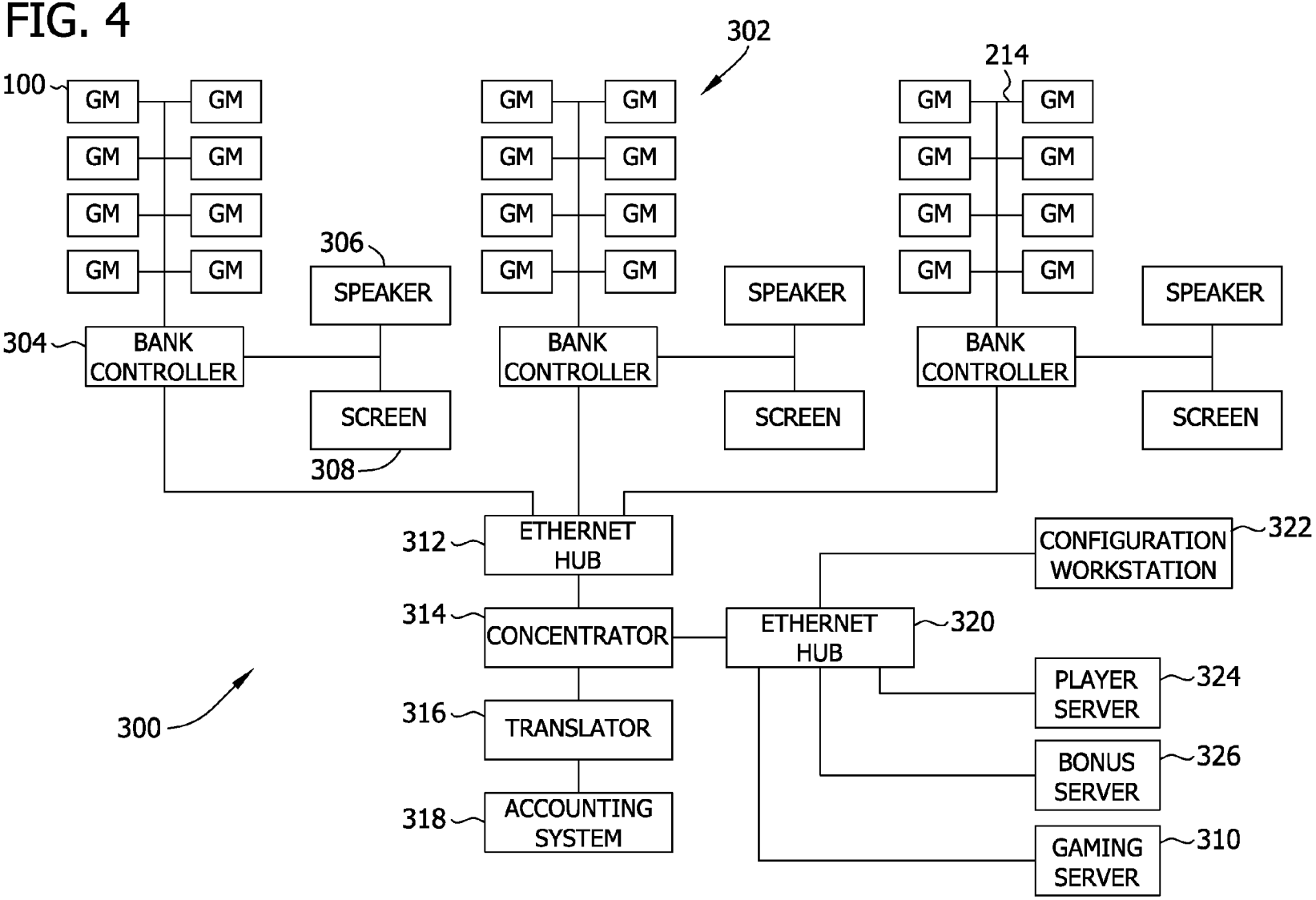
FIG. 4 is a block diagram of an exemplary gaming network that includes a plurality of the gaming devices shown in FIGS. 1 and 2.

FIG. 4 is a block diagram of an exemplary gaming network 300 that includes a plurality of gaming devices 100. Specifically, FIG. 4 illustrates three banks 302 of gaming devices 100. Each gaming device 100 is coupled via network connection 214 to a bank controller 304. In one embodiment, each bank controller 304 includes a processor (not shown) that facilitates data communication between each gaming device 100 within each bank 302, and between each gaming device 100 and other components of gaming network 300. In one embodiment, each bank controller 304 also includes audio capabilities, such as a CD-ROM drive (not shown) or DVD-ROM drive (not shown), that are coupled to a sound card (not shown) for processing and transmitting digitized sound effects to one or more speakers 306 in response to commands issued over gaming network 300 by bank controller 304. Each bank controller 304 is also coupled via gaming network 300 to an electronic sign or screen 308 that displays information, such as via scrolling and/or flashing messages that indicate, for example, progressive and/or jackpot amounts, and that are visible to players playing gaming devices 100. Messages for display on each electronic screen 308 are generated and/or modified in response to commands issued over gaming network 300 by bank controller 304.

As described above, gaming devices 100 may include video poker machines, video slot machines, and/or other similar gaming machines that implement alternative games. Moreover, gaming devices 100 may be terminal-based machines, wherein the actual games, including random number generation and/or outcome determination, are performed at a remote gaming server 310. In such an embodiment, gaming device 100 displays results of the game played on gaming server device via primary display 116 (shown in FIGS. 1 and 3). Further, gaming devices 100 may be kiosks, vending machines, or any other suitable devices that monitor event occurrences.

A network connector, such as an Ethernet hub 312, couples each bank controller 304 to a concentrator 314. Concentrator 314 functions as a data control switch that routes data from each bank 302 to a translator 316. Translator 316 provides a compatibility buffer (not shown) between concentrator 314 and an accounting system 318. Moreover, translator 316 converts data gathered from each bank 302 into a format that is compatible with accounting system 318.

Another Ethernet hub 320 couples concentrator 316 to a configuration workstation 322, a player server 324, and to one or more bonus servers 326. Configuration workstation 322 includes a user interface that enables an administrator to set up and/or to modify portions of gaming network 300 and/or servers 310, 324, and 326. Player server 324 tracks data of players using gaming devices 100. Player server 324 also controls messages that appear on each primary display 116 and/or information panel 126 (shown in FIGS. 1 and 3) of gaming devices 100. In the exemplary embodiment, player server 324 also stores physical characteristics of players, such as the player age and/or vision data. Bonus server 326 controls bonus applications or bonus systems on gaming network 300. Bonus server 326 includes a set of rules for use in awarding jackpots in excess of those established by winning pay tables (not shown) of each gaming device 100. Some bonus awards may be awarded randomly, while other bonus awards may be made to groups of gaming devices 100 operating in a progressive jackpot mode.

During operation, controller 202 (shown in FIG. 3) monitors one or more events including events such as, but not limited to, coin in, games played, awards paid out, tickets printed, and/or a number of tickets remaining in a ticket hopper (not shown). Controller 202 transmits a signal to one or more of servers 310, 324, and 326 for each event occurrence. Alternatively, controller 202 may periodically transmit a signal to one or more of servers 310, 324, and 326, wherein the signal includes a number of occurrences of each event during a predetermined time period. In the exemplary embodiment, for each occurrence of a particular event detected by controller 202, a signal is transmitted by controller 202 to a corresponding indicator 132 (shown in FIGS. 2 and 3) within meter assembly 134 (shown in FIG. 2). In response to the signal, the corresponding indicator 132 increments to show that a new occurrence of the event has occurred. At a predetermined time or according to a predetermined action, indicators 132 are illuminated by light devices 218 (shown in FIG. 3). In one embodiment, controller 202 detects a user input via switch 220 (shown in FIG. 3), or via a combination of button presses, and transmits a signal to a particular light device 218. In another embodiment, one of servers 310, 324, and 326 transmits a signal to controller 202 via network 300, and controller 202 transmits a corresponding signal to a corresponding indicator 132 within meter assembly 134. The particular light device 218 illuminates a corresponding indicator 132 to display, for example, a number of games played using gaming device 100. Illuminating indicator 132 via light device 218 facilitates making indicator 132 visible through shield 130 (shown in FIG. 1).

In an alternative embodiment, controller 202 monitors one or more components of gaming device 100. When controller 202 detects that an issue that requires attention by personnel has occurred, controller 202 transmits a signal to a corresponding indicator 132. Alternatively, one of servers 310, 324, and 326 detects that a component is in need of service and transmits a signal to controller 202 via network 300, and controller 202 transmits a corresponding signal to indicator 132. In response to the signal, indicator 132 displays an event indication corresponding to the need for attention. For example, indicator 132 may be illuminated by a particular light device 218 in order to be viewable through shield 130. Alternatively, service personnel may be required to input a command via switch 220, or via a combination of button presses in order for indicator 132 to be illuminated by light device 218, thereby making indicator 132 viewable through shield 130.

In another alternative embodiment, controller 202 monitors game play on gaming device 100. When controller 202 detects, for example, a bonus triggering event, controller 202 transmits a signal to a corresponding bonus indicator 132. Alternatively, bonus server 326 detects a bonus triggering event, transmits a signal to controller 202, and controller 202 transmits a corresponding signal to bonus indicator 132. In response to the signal, indicator 132 displays, for example, a bonus image. Moreover, in one embodiment, controller 202 transmits a signal to a particular light device 218 rather than to a particular indicator 132, and the particular light device 218 illuminates a corresponding indicator 132, thereby making the indicator 132 visible through shield 130.

Figure 5:
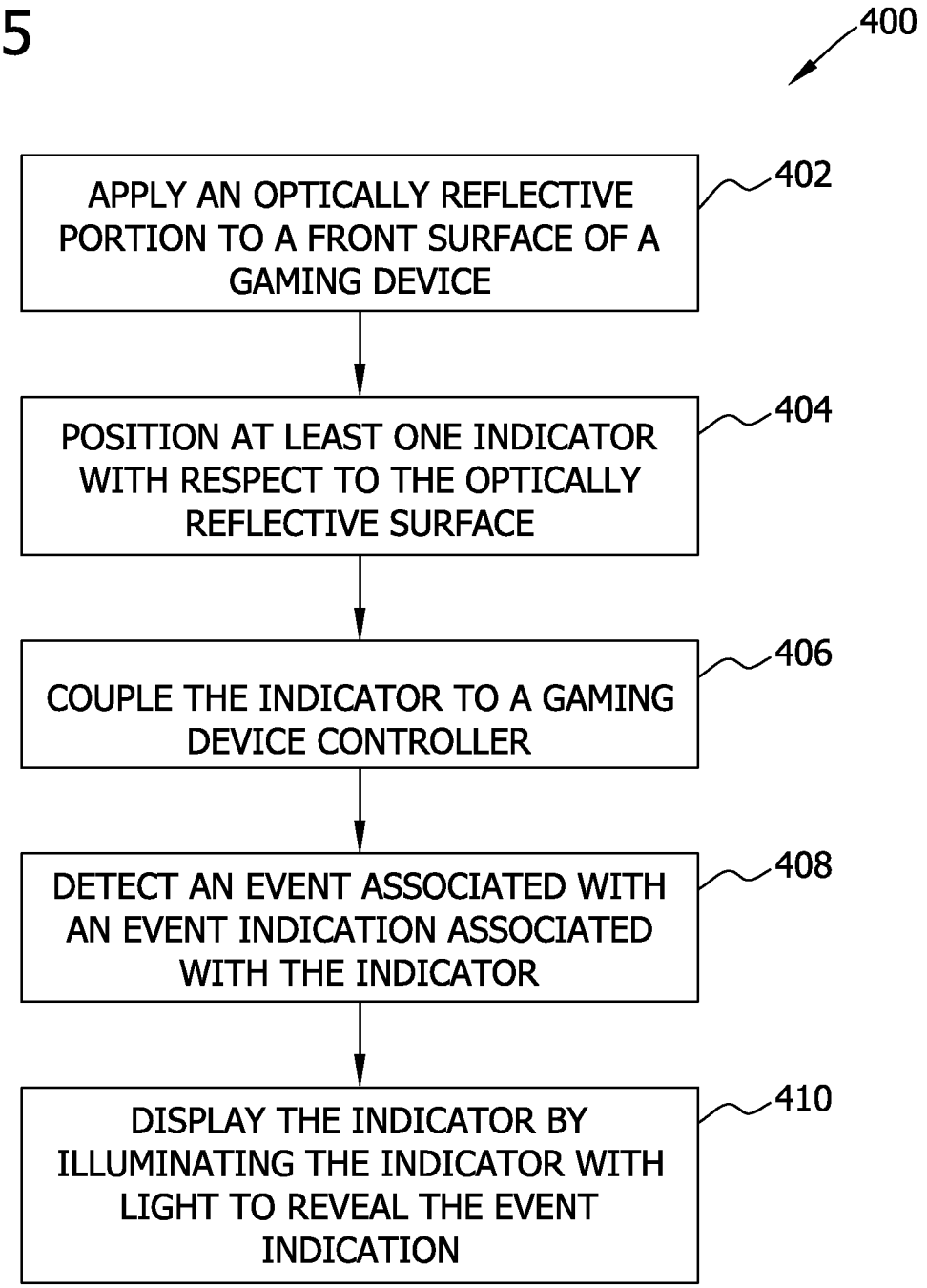
FIG. 5 is a flowchart illustrating an exemplary method for displaying an event indication using the gaming device shown in FIGS. 1 and 2.

FIG. 5 is a flowchart 400 illustrating an exemplary method for displaying an event indication for a gaming device, such as gaming device 100 (shown in FIGS. 1-3). In the exemplary embodiment, an optically restrictive portion such as shield 130 (shown in FIG. 1) is applied 402 to front surface 104 (show in FIG. 1) of gaming device 100. In the exemplary embodiment, shield 130 is an optically reflective material. In an alternative embodiment, shield 130 is an optically opaque material. In the exemplary embodiment, shield 130 is applied to an inner surface of main cabinet 102 (shown in FIG. 1) via vapor deposition such that a film of a metallic substance, such as chrome, titanium, gold, or silver is applied. However, it should be understood that any metallic or metalized substance may be used. In an alternative embodiment, shield 130 includes polarized glass that prevents external visibility into gaming device 100. In another alternative embodiment, shield 130 is a tape or other suitable material that is applied to either an inside surface of front surface 104 or an outside surface of front surface 104. In yet another alternative embodiment, shield 130 is fabricated via an in-mold decorating process.

In the exemplary embodiment, one or more indicators 132 (shown in FIGS. 2 and 3) are positioned 404 with respect to the optically restrictive portion. Moreover, indicators 132 are coupled 406 to controller 202 (shown in FIG. 3). Thereafter, controller 202 monitors operation of gaming device 100 in order to detect 408 an event associated with an event indication. In the exemplary embodiment, for each occurrence of a particular event detected by controller 202, a signal is transmit by controller 202 to a corresponding indicator 132 within meter assembly 134 (shown in FIG. 2). In response to the signal, the corresponding indicator 132 increments to show that a new occurrence of the event has occurred. In an alternative embodiment, controller 202 monitors one or more components of gaming device 100. When controller 202 detects that an issue that requires attention by personnel has occurred, controller 202 transmits a signal to a corresponding indicator 132. In response to the signal, indicator 132 displays an event indication corresponding to the need for attention. In another alternative embodiment, controller 202 monitors game play on gaming device 100. When controller 202 detects, for example, a bonus triggering event, controller 202 transmits a signal to a corresponding bonus indicator 132. In response to the signal, indicator 132 displays, for example, a bonus image.

In the exemplary embodiment, controller 202 controls display 410 of indicator 132 in order to reveal the event notification. More specifically, in the exemplary embodiment, at a predetermined time or according to a predetermined action, indicators 132 are illuminated by light devices 218 (shown in FIG. 3). In one embodiment, controller 202 detects a user input via switch 220 (shown in FIG. 3) or via a combination of button presses, and transmits a signal to a particular light device 218. The particular light device 218 illuminates a corresponding indicator 132 to display, for example, a number of games played using gaming device 100. Illuminating indicator 132 via light device 218 facilitates making indicator 132 visible through shield 130. In an alternative embodiment, indicator 132 displays an event indication corresponding to service required by a component of gaming device 100. For example, indicator 132 may be illuminated by a particular light device 218 in order to be viewable through shield 130. In another alternative embodiment, when controller 202 detects a bonus triggering event, bonus indicator 132 displays, for example, a bonus image. Moreover, in one embodiment, controller 202 transmits a signal to a particular light device 218 rather than to a particular indicator 132, and the particular light device 218 illuminates a corresponding indicator 132, thereby making indicator 132 visible through shield 130.

The systems, methods, and apparatus described herein facilitate improving visibility of gaming device indicators while simultaneously shielding the indicators from unauthorized viewers. Shielding the indicators from unauthorized viewers facilitates protecting against employee theft and aids in meeting regulatory requirements that mandate recording of important events using one or more hard count meters or indicators. Moreover, improving visibility of the indicators facilitates decreasing an amount of time necessary to read the indicators by, for example, service personnel and/or regulatory personnel. Furthermore, the systems, methods, and apparatus described herein facilitate use of a "hide/reveal" theme to announce a bonus award and/or during play of a bonus game. In addition, service calls for components of a gaming device may be more easily diagnosed.

When introducing elements of aspects of the invention or embodiments thereof, the articles "a," "an," "the," and "said" are intended to mean that there are one or more of the elements. The terms "comprising," including," and "having" are intended to be inclusive and mean that there may be additional elements other than the listed elements.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A gaming device comprising:

a cabinet including a front surface, at least a portion of said front surface including an optically restrictive material;

a primary display supported by the cabinet and configured to display a play of a game;

a meter assembly supported by the cabinet, said meter assembly being separate from and in addition to the primary display, said meter assembly including at least two indicators and at least two light devices, each indicator:

(a) being associated with a different one of the light devices, (b) being positioned behind the optically restrictive material such that said indicator is not visible through said optically restrictive material when the associated light device is not illuminated, and such that said indicator is visible through said optically restrictive material when the associated light device is illuminated, and (c) including a counter; and a controller configured to operate with the meter assembly to, for each indicator:

(a) detect an occurrence of an event associated with said indicator, wherein the event associated with said indicator is different from the event associated with any other indicator and wherein the event is related to service for a particular component of the gaming device, (b) increment the counter of said indicator to indicate the occurrence of the event associated with said indicator, and (c) illuminate the light device associated with said indicator in response to the counter of said indicator reaching a designated number.

2. A gaming device in accordance with claim 1, wherein said optically restrictive material includes a film applied across at least a portion of said front surface.

3. A gaming device in accordance with claim 2, wherein said film includes a metallic substance applied via a vapor deposition process.

4. A gaming device in accordance with claim 1, wherein said optically restrictive material includes a polarized glass.

5. A gaming device in accordance with claim 1, wherein said optically restrictive material is fabricated via an in-mold decorating process.

6. A gaming device in accordance with claim 1, wherein said optically restrictive material includes an optically reflective material.

7. A gaming device in accordance with claim 1, wherein said optically restrictive material includes an optically opaque material.

8. A gaming device in accordance with claim 1, wherein meter assembly further includes a housing configured to couple said meter assembly to said cabinet.

9. A gaming device in accordance with claim 1, wherein each of the at least two indicators includes an electromechanical meter.

10. A gaming device in accordance with claim 1, wherein one of the at least two indicators is configured to become visible through the optically restrictive material when at least one component of said gaming device requires attention.

11. A gaming device in accordance with claim 10, wherein the controller is further configured to monitor said gaming device and to transmit a signal to one of said at least two indicators when the at least one component requires attention.

12. A gaming device in accordance with claim 1, wherein one of said at least two indicators includes a lip portion coupled along one edge of said cabinet, said lip portion configured to hinge at said edge to display the event indication.

13. A gaming device in accordance with claim 1, further including at least one switch coupled to at least one of the light devices, said at least one switch configured to transmit a signal to said at least one of the light devices to illuminate an indicator of the at least two indicators that is associated with the at least one of the light devices.

14. A gaming device in accordance with claim 13, wherein said at least one switch includes a plurality of buttons, said at least one of the light devices is configured to illuminate said indicator upon a combination of button presses.

15. A method for selectively displaying meter information for a gaming device that includes a cabinet including a front surface, at least a portion of said front surface including an optically restrictive material, a primary display supported by the cabinet and configured to display a play of a game, and a meter assembly supported by the cabinet, said meter assembly being separate from and in addition to the primary display, and said meter assembly including at least two indicators and at least two light devices, said method comprising:

for each indicator:

(a) detecting, by a controller, an occurrence of an event associated with said indicator, wherein the event associated with said indicator is different from the event associated with any other indicator and wherein the event is related to service for a particular component of the gaming device;

(b) incrementing, by the controller, a counter of said indicator to indicate the occurrence of the event associated with said indicator, and (c) illuminating, by a controller, a light device associated with said indicator in response to the counter of said indicator reaching a designated number, said indicator is associated with a different one of the light devices from the light devices associated with any other indicator, said indicator and the associated light device being positioned behind the optically restrictive material such that said indicator is not visible through the optically restrictive material when the associated light device is not illuminated, and such that said indicator is visible through the optically restrictive material when the associated light device is illuminated.

16. A method in accordance with claim 15, wherein the optically restrictive material includes a film across an inner surface of the cabinet.

17. A method in accordance with claim 16, wherein the optically restrictive film includes a metallic substance applied using a vapor deposition process.

18. A method in accordance with claim 15, wherein the optically restrictive material includes a polarized glass coupled to the front surface.

19. A method in accordance with claim 15, wherein the at least two indicators are coupled to a controller.

20. A method in accordance with claim 15, wherein one of the at least two indicators includes a lip portion coupled along one edge to the cabinet.

21. A method in accordance with claim 15, further including detecting an activation of a switch coupled to the gaming device.

22. A method in accordance with claim 15, further including detecting a combination of button presses input using a plurality of buttons coupled to the front surface of the cabinet.

23. A gaming system comprising:

at least two gaming devices, each gaming device comprising:

a cabinet including a front surface, at least a portion of said front surface including an optically restrictive material, a primary display supported by the cabinet and configured to display a play of a game, and a meter assembly supported by the cabinet, said meter assembly being separate from and in addition to the primary display, said meter display including a at least two indicators and at least two light devices, each indicator:

(a) being associated with a different one of the light devices;

(b) being positioned behind said optically restrictive material such that said indicator is not visible through the optically restrictive portion when the associated light device is not illuminated, and such that said indicator, is visible through said optically restrictive material when the associated light device is illuminated, and (c) including a counter;

a controller configured to operate with said meter assembly; and at least one server coupled to said plurality of gaming devices via a network, said at least one server configured to operate with the meter assembly and the controller of each gaming device to:

(a) detect the occurrence of an event associated with one of the at least two indicators, wherein the event associated with said indicator is different from the event associated with any other indicator and wherein the event is related to service for a particular component of the gaming device, and (b) instruct the controller to increment the counter of said indicator based on the occurrence of the event associated with said indicator, and (c) illuminate the light device associated with said indicator in response to the counter of said indicator reaching a designated number.

24. A gaming system in accordance with claim 23, wherein said optically restrictive material includes a film applied across at least a portion of said front surface.

25. A gaming system in accordance with claim 24, wherein said film includes a metallic substance applied via a vapor deposition process.

26. A gaming system in accordance with claim 23, wherein said optically restrictive material includes a polarized glass.

27. A gaming system in accordance with claim 23, wherein said optically restrictive material is fabricated via an in-mold decorating process.

28. A gaming system in accordance with claim 23, wherein said optically restrictive material includes an optically reflective material.

29. A gaming system in accordance with claim 23, wherein said optically restrictive material includes an optically opaque material.

30. A gaming system in accordance with claim 23, wherein said at least one server is configured to operate with the controller of each of said at least two gaming devices to monitor at least one component of each of said at least two gaming devices, and to transmit a signal to said controller when the at least one component requires attention.

31. A gaming system in accordance with claim 23, wherein one of said at least two indicators includes a lip portion coupled along one edge to said cabinet, said lip portion configured to hinge at said edge to display the event indication.

32. A gaming system in accordance with claim 23, wherein each gaming device of said at least two gaming devices further includes:

at least one switch coupled to at least one of the at least two light devices, said at least one switch configured to transmit a signal to said at least one light device to illuminate an indicator associated with the at least one light device.

33. A gaming system in accordance with claim 32, wherein said at least one switch includes a plurality of buttons, said at least one light device configured to illuminate the indicator upon a combination of button presses.

* * * * *